US007674341B2

(12) United States Patent
Stansilaw et al.

(10) Patent No.: US 7,674,341 B2
(45) Date of Patent: Mar. 9, 2010

(54) APPARATUS AND METHODS FOR CLEANING COMBUSTION SYSTEMS

(75) Inventors: Andrew Stansilaw, Alliston (CA); Tony Ferraro, Mississauga (CA); John Charles Muir, Toronto (CA); Phil Trigiani, Mississauga (CA)

(73) Assignee: UView Ultraviolet Systems Inc., Mississauga (CA)

( * ) Notice: Subject to any disclaimer, the term of this patent is extended or adjusted under 35 U.S.C. 154(b) by 765 days.

(21) Appl. No.: 11/464,391

(22) Filed: Aug. 14, 2006

(65) Prior Publication Data

US 2007/0012342 A1 Jan. 18, 2007

(51) Int. Cl.
*B08B 9/02* (2006.01)

(52) U.S. Cl. ..... 134/166 C; 134/169 A

(58) Field of Classification Search ..... None
See application file for complete search history.

(56) References Cited

U.S. PATENT DOCUMENTS 4,807,578 A * 2/1989 Adams et al. ..... 123/198 A
4,909,207 A * 3/1990 Takano et al. ..... 123/198 A
5,289,837 A * 3/1994 Betancourt ..... 134/57 R
5,629,212 A * 5/1997 Herman et al. ..... 436/125
6,167,872 B1 * 1/2001 Campagna et al. ..... 123/538

FOREIGN PATENT DOCUMENTS

WO 98/47982 10/1998
WO 98/51924 11/1998

* cited by examiner

*Primary Examiner*—Michael Kornakov
*Assistant Examiner*—Ryan Coleman
(74) *Attorney, Agent, or Firm*—K&L Gates LLP

(57) ABSTRACT

The invention provides compositions and methods for more thoroughly cleaning internal combustion engines, fuel systems and emission systems and that operate with reduced toxic emissions. The invention provides an apparatus that contains at least one vessel for receiving a cleaning fluid and an electrode in a cleaning fluid flow path configured to apply a charge to a cleaning fluid. The cleaning fluids are unique fuel derived products which do not contain detergents. The apparatus is unique in that it can provide any of several cleaning processes including a pre-combustion cleaning process, a post-combustion cleaning process or a combined pre-combustion and post-combustion cleaning process. The method is particularly effective at cleaning oxygen sensors in exhaust systems.

28 Claims, 9 Drawing Sheets

AEROSOL CAN
20
26
28
AIR PRESSURE SOURCE
WATER SEPARATOR
AEROSOL CAN
20
10
18
30
18
34
94
16
AIR PRESSURE REGULATOR
16
22
24
38
36
38
12
14
44
POWER SUPPLY
42
46
70
40
32
RELAY SWITCH
72
3-WAY VALVE
62
74
78
76
CHECK VALVE
80
96
FUEL FILTER
82
86
84
FUEL LINE CONNECT
CONNECT TO ENGINE

APPARATUS AND METHODS FOR CLEANING COMBUSTION SYSTEMS

The present invention relates to compositions and methods for cleaning combustion systems and, more particularly, to compositions and methods for cleaning combustion chambers and fuel and exhaust systems of a gasoline internal combustion engines.

BACKGROUND OF THE INVENTION

As a result of the normal operation of an internal combustion engine, carbon and other organic compounds tend to build up on internal surfaces of the engine, as well as in the exhaust system, including the oxygen sensor and catalytic converter. Compositions and methods have been devised that flush engines with cleaning fluid or other types of chemical solvent solutions in an attempt to clean these surfaces. In one such system, a separate canister containing a liquid mixture of engine fuel and injector cleaning solvent is connected to the fuel line, and the engine is operated using the fuel solvent mixture.

The use of such fuel solvent mixtures can be problematic. For example, strong solvents can be corrosive and can damage the internal surfaces of the engine and the oxygen sensor. Additionally, typical conventional solvent and detergent cleaning fluids are mixed with gasoline and the automobile engine is run during cleaning. When these cleaning fluids are successful in dislodging or removing carbon deposits they essentially only move the deposits downstream to the combustion chamber and/or exhaust system. Emissions during such a "cleaning treatment process" are dramatically increased as the carbon and sludge moves further into the engine. Following such treatments, an operator must drive the treated vehicle for a full tank of gas before the vehicle can pass an emissions test.

Another poor aspect of this technology the effect of harmful emissions on the environment. Even though a treatment may only be for 1 h or less per vehicle service, it is estimated that there are millions of vehicles being serviced annually on a global scale and the numbers will continue to expand as electronics grow more sophisticated and prevalent in modern vehicles and the cumulative effect of these emissions is substantial. The exposure of technicians servicing automobiles to the toxic fumes produced during treatment is also problematic. Service technicians are already exposed to hundreds of toxins and harmful chemicals and the known engine cleaning methods and compositions only add to this problem in the service area. In the United States some states have begun to send information encouraging service facilities to cease using some of these chemicals because of the potential effects and possible litigation.

Thus, new engine cleaning methods are needed that can clean engines more thoroughly without leaving deposits downstream of the combustion chamber and that have reduced or no toxic emissions.

SUMMARY OF THE INVENTION

The present invention provides compositions and methods for more thoroughly cleaning internal combustion engines, fuel systems and emission systems and that have reduced toxic emissions. The invention provides an apparatus that contains at least one vessel for receiving a cleaning fluid and an electrode in a cleaning fluid flow path configured to apply a charge to a cleaning fluid. The apparatus is unique in that it can provide any of several cleaning processes including a pre-combustion cleaning process, a post-combustion cleaning process or a combined pre-combustion and post-combustion cleaning process.

The invention also covers methods for using the apparatus to clean an engine comprising: providing a pre-combustion cleaning fluid; and a post-combustion cleaning fluid; controlling output of at least one of the cleaning fluids to a fuel delivery apparatus that delivers the cleaning fluids to an engine fuel system and operating the engine using at least one or both of the cleaning fluids. Preferably, the treatment protocol includes alternate sequential output of the pre-combustion and post-combustion cleaning fluids to the fuel delivery system. The engine is then operated for a predetermined time period using either one of the non-detergent cleaning fluids or the fuel derivative. The engine can be operated from about 10 to about 60 min during treatment. The method is particularly effective at cleaning oxygen sensors in exhaust systems.

In an embodiment, the apparatus is portable.

In an embodiment, the vessel in the apparatus contains a cleaning fluid that is primarily an engine fuel component enriched in aromatic compounds.

In an embodiment, the vessel in the apparatus contains a cleaning fluid that is primarily an engine fuel component enriched in aliphatic compounds. The electrode in the vessel can be negatively charged and impart a negative charge to the cleaning fluid as it is passed into the engine.

In an embodiment the apparatus contains a second vessel for receiving a cleaning fluid. In such embodiments both cleaning fluids can be loaded into the vessels and a cleaning process such as a pre-combustion and post-combustion cleaning process can be completed without the need to stop the process and refill a vessel.

The invention also provides cleaning fluids. In an embodiment a pre-combustion cleaning fluid contains no detergents and contains a fuel component enriched with aromatic hydrocarbons. In an embodiment a post-combustion cleaning fluid is provided that contains a fuel component enriched in aliphatic hydrocarbons. Preferably the A cleaning solution consisting essentially of an engine fuel enriched with aliphatic fuel components. Preferably these cleaning fluids are treated so that they contain a negative charge. The charge can emanate from the vehicle battery which can be 12 Volts or can be supplied from the apparatus via a power supply, a battery or rechargeable battery.

The invention further provides containers for storing the cleaning fluids and which can be conveniently used to transfer their contents into the device. The container includes a hermetically sealed container containing a pre-determined amount of fuel system cleaning fluid. The top of the container body has a prescribed threading configured to connect with a threaded adapter of a vessel of the engine cleaning apparatus. The container can be filled with an inert carrier gas and pressurized to facilitate fluid transfer and avoid combustion. In an embodiment the container top is threaded with prescribed threading which, in an embodiment, is a male ½"-24 Unified Special (UNS) right-handed thread.

Additional features and advantages of the present invention are described in, and will be apparent from, the following Detailed Description of the Invention and the figures.

DETAILED DESCRIPTION OF THE INVENTION

Figure 1:
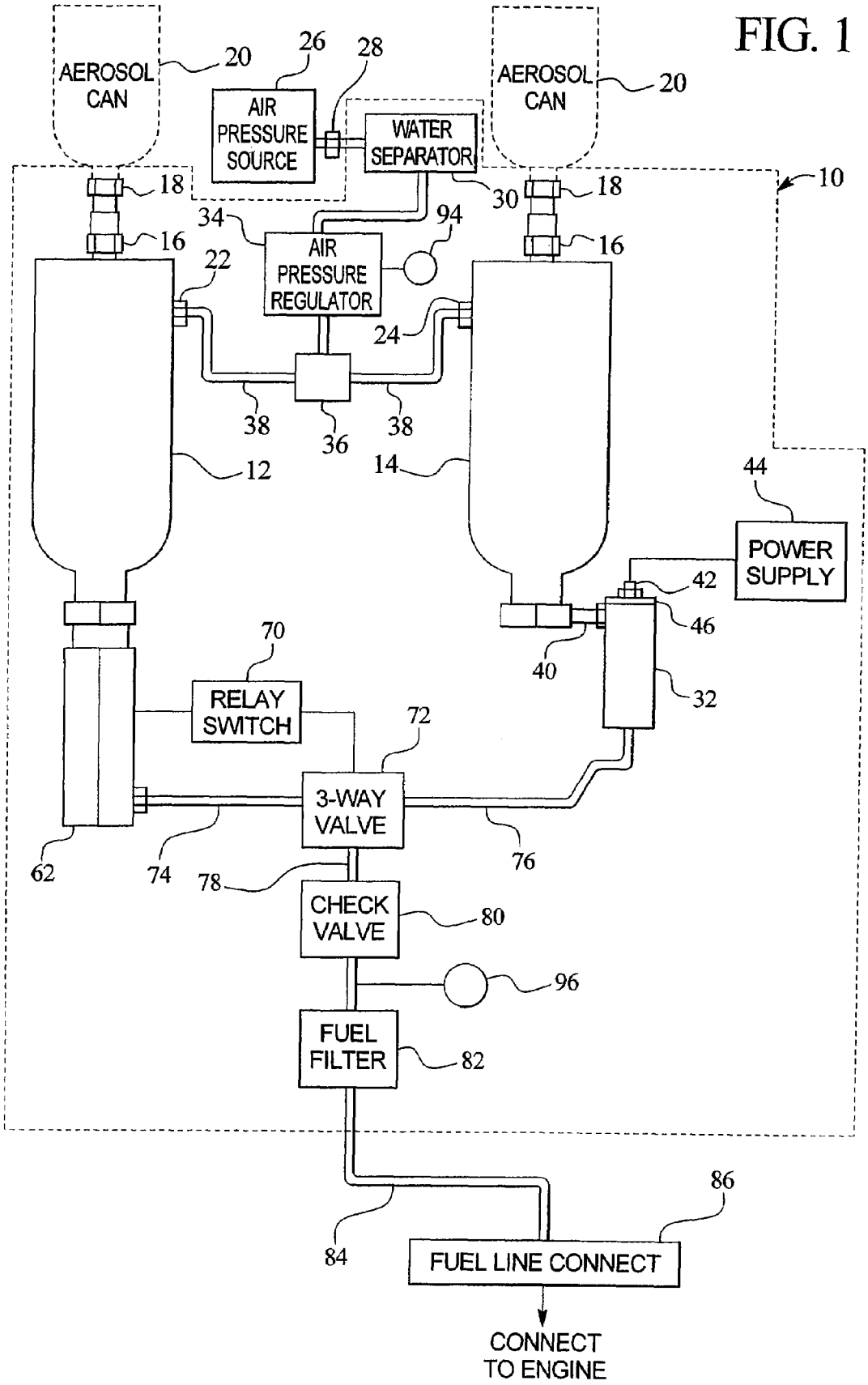
FIG. 1 is a schematic view of an apparatus according to the present disclosure.

The invention provides liquid cleaning fluids for removing carbon and other compounds that build up on internal surfaces of engines, as well as in the catalytic converter and oxygen sensor(s) and an apparatus that receives the cleaning fluids and introduces them to internal combustion engines.

The liquid cleaning fluids can be made up entirely of components of fuel for internal combustion engines. In an embodiment, a cleaning solution is provided that is enriched for the aliphatic hydrocarbon component of fuel. In an embodiment, a cleaning solution is provided that is enriched in an aliphatic hydrocarbon component of fuel. The cleaning solutions can be prepared by separating fuel into two components, one component being enriched for the aliphatic hydrocarbon molecules and another component being enriched for aromatic fuel components. The enriched fuel components can be prepared by standard methods known in the art. The aromatic hydrocarbon enriched fuel component is preferred for use as a pre-combustion cleaning fluid as it is considered more effective for cleaning pre-combustion surfaces, as defined above. For purposes of the present invention the aliphatic hydrocarbon enriched component is termed the post-combustion cleaning solution or cleaning fluid.

The fuels of the invention can be further treated to improve their cleaning and combustion characteristics. For example, the enriched fuel cleaning fluids can be treated such that they acquire a negative charge which when passed into a combustion chamber have improved combustion characteristics over their untreated counterparts. Suitable methods for processing such fuels for use in the present invention are known, see for example the method described in publication No. WO 98/47982, entitled "Fuel and Process for Fuel Production", which is incorporated herein by reference. Both pre and post-combustion cleaning fluids can be processed by this method and used.

Molecular reactors for producing suitable fuels are known for example publication No. WO 98/51924 entitled "Molecular Reactor for Fuel Induction," which is incorporated herein by reference describes one such reactor and method. Generally, vaporized fuel, which has been processed according to this method, is allowed to condense and packaged in a liquid form in aerosol cans prior to use by the present methods. While such packaged cleaning fluids will remain effective for long periods of time, superior results can be obtained when such processed cleaning fluids are used within a few weeks to a month of preparation. Essentially the apparatus and method claimed will rejuvenate the condensed fuel immediately prior to use to enable superior results as described WO 98/51924.

In an embodiment, a vessel is provided that is configured to receive and prepare a first type of cleaning fluid for pre-combustion surfaces within the engine. Pre-combustion surfaces include fuel injectors, fuel rail, intake valve, exhaust gas recirculating (EGR) valves, the intake manifold, throttle plates, Idle Air Control (IAC) motor, the fuel pressure regulator, and cylinder head ports.

In an embodiment, a vessel is provided that is configured to receive and prepare a second type of cleaning fluid for post-combustion surfaces of the engine, including piston heads, cylinder walls, exhaust valves, oxygen sensors, and catalytic converter for example. The use of a single vessel or container in the apparatus requires that the operator would need to refill the vessel or container after the first service, if both services (i.e., using both the first and second types of cleaning fluid) were carried out. Therefore, in an embodiment, a vessel is provided that is configured to receive and prepare two cleaning fluids including a first type of cleaning fluid for pre-combustion surfaces within the engine and a second type of cleaning fluid for post-combustion surfaces of the engine. It can be appreciated that the cleaning properties of the first and second cleaning fluids are not mutually exclusive and that each cleaning fluid can have some ability to clean both types of surfaces. However, the first cleaning fluid is particularly effective at cleaning pre-combustion surfaces while the second cleaning fluid is particularly effective at cleaning post-combustion surfaces.

Turning to the drawings, FIG. 1 illustrates a treatment apparatus 10 enclosed in a dashed line having a first receiving vessel 12 and a second receiving vessel 14. Each of the vessels includes a one-way check valve 16 and a threaded piercing adapter 18 that provides for fluid connection of aerosol cans 20 containing the different types of liquid fuel/cleaner with receiving vessels 12 and 14. For example, the liquid fuel resulting from the treatment in a molecular reactor, described previously, may be transported and distributed in pressurized threaded aerosol containers 20. Generally it is thought that the containers will have a volume in the range of 100-500 ml but it can be appreciated that the container size will depend on the engine being treated and may in some instances be outside of this range. In the illustrated embodiment of apparatus 10 first vessel 12 receives a pre-combustion cleaner/fuel fluid and the second vessel 14 receives a post-combustion cleaner/fuel fluid.

In order to affect a motive force for the expulsion of the fuel/cleaners from the vessels 12 and 14, as well as pressurize the fuel/cleaners, each of the vessels includes an air inlet port 22 and 24, respectively. Ports 22 and 24 allow the receipt of pressurized air from an air pressure source 26, which can be external to apparatus 10, as illustrated, but not necessarily so. Air pressure source 26 can be a built in compressor such as a 12 Volt or 24 Volt compressor or could also be a prefilled pressurized air tank. The air pressure source 26 can be connected to an air inlet fitting 28, adaptable for connection to a variety of air pressure sources, such as air compressors or pneumatic air systems. In an embodiment, a water separator can be connected to the air inlet fitting 28 to remove any water from the air pressure source or air conduit, particularly if the air supply does not already contain a drier. Removal of water is important because water can cause a short circuit in an electrode vessel 32, which will be described later. In an alternate embodiment the use of an electric fuel pump could be used instead of air.

An air pressure regulator 34 can be connected to air inlet 28, optionally, via the water separator 30. Regulator 34 affords regulation of the air pressure of the received air. The particular value of the air pressure can be controlled from a control panel, for example, to enable a user of apparatus 10 to set the air pressure to a desired level. Air output from the regulator 34 can be delivered to vessels 12 and/or 14 via an air distribution device, such as Tee adaptor 36 and associated air conduits 38.

Electrode vessel 32 can be attached to second vessel 14 via an outlet coupling 40 allowing the flow of fuel from vessel 14 to electrode vessel 32. A high voltage electrode assembly 42 is disposed within electrode vessel 32 to impart a negative electrical charge to the fuel/cleaner. A terminal of the electrode assembly 42 is connected to high voltage power supply 44. Suitable power supplies can provide output voltages of up to at least about −1100 volts DC, however any voltage that can impart a sufficient negative electrical charge to liquid fuel particularly the post-combustion fuel/cleaner from vessel 14 is suitable and can be used. This charging can be carried out without any operator interface.

Figure 2:
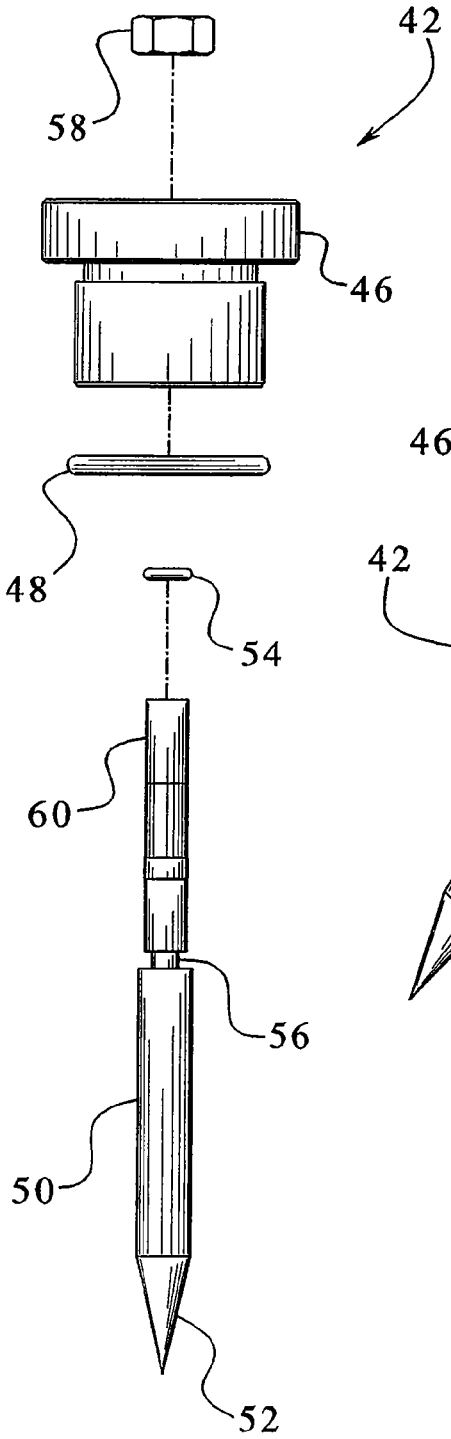
FIG. 2 illustrates an exploded view of an electrode assembly for use with the apparatus of FIG. 1.
Figure 3:
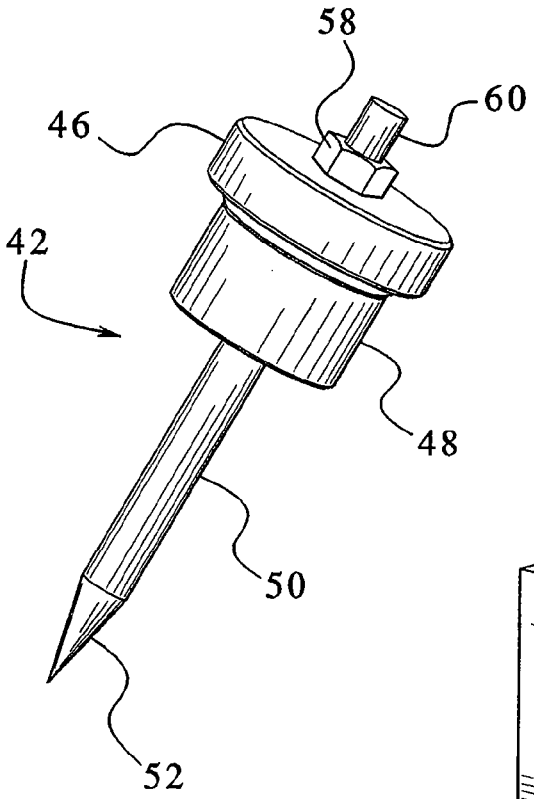
FIG. 3 illustrates an assembled view of the electrode assembly of FIG. 2.

FIGS. 2 and 3 further illustrate an electrode assembly 42 in more detail. As illustrated in the exploded view of FIG. 2, electrode assembly 42 can be configured to be removably fitted into vessel 32. Accordingly, electrode 42 includes a threaded insulated collar 46 and a first O-ring 48 for sealing threaded insulated collar 46 and, thus, the electrode assembly 42 within vessel 32. Threaded insulated collar 46 can be constructed of any material (e.g., nylon) that electrically isolates electrode 50 from vessel 32, as well as the other parts of apparatus 10 and the engine to be treated (not shown). As illustrated in FIG. 2, electrode 50 can include a sharpened cone tip 52. Further features of the electrode assembly 42 include a second O-ring 54 disposed on an electrode O-ring shoulder 56 and pressed into the threaded insulated collar 46. A nut 58 or any similar holding device can be used to secure the electrode 50, which can be threaded, to collar 46. A terminal portion 60 of electrode 50 is exposed for allowing connection of electrode 50 to high voltage power supply 44. An assembled view of electrode assembly 44 is illustrated in FIG. 3. In alternate embodiments, the electrode design can vary. For example, the electrode can be of a halo or a circular design as long as it can impart a negative charge on the fuel in the reactor.

Referring again to the example of FIG. 1, a liquid level measuring chamber 62 is illustrated connected to vessel 12 and receives fuel/cleaner mixture from vessel 12. Chamber 62 includes a liquid level measuring apparatus that serves to detect a particular level of fuel/cleaner within chamber 62 supplied from vessel 12. In particular, when a low level of liquid is detected by the liquid level measuring apparatus, electrical contacts are closed, thereby generating a signal that nearly all of the liquid in vessel 12 has been expelled. A variety of liquid level sensors are known in the art and can be used. Suitable sensors include optical, ultrasonic, or specific gravity type sensors. Apparatus 10 can be used repeatedly as a single treatment with only the pre-combustion cleaner or only the post-combustion cleaner depending on the severity of the carbon problem and the service offered by the facility. The unit also has an automatic process to allow both treatments to work uninterrupted and in series.

Figure 4:
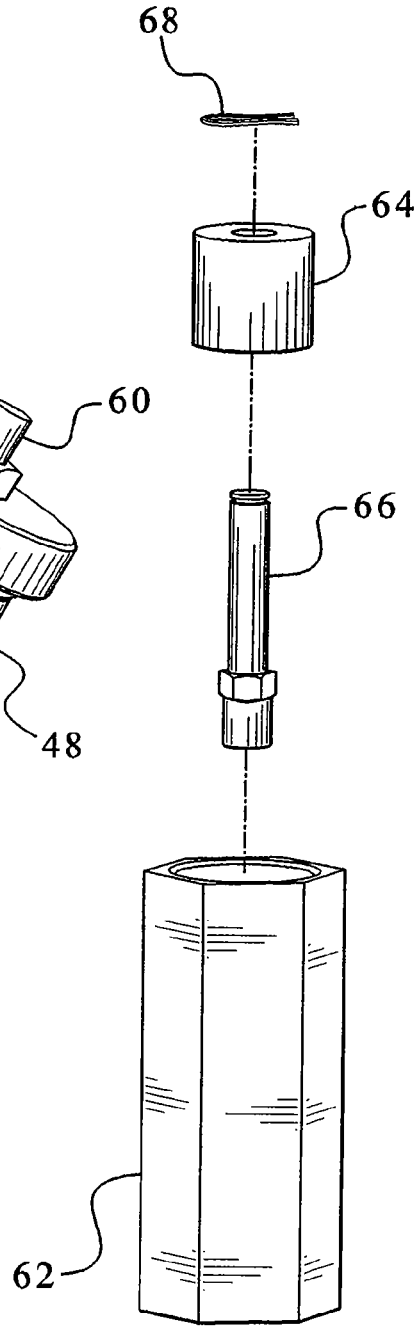
FIG. 4 is an exploded view of a portion of the apparatus of FIG. 1 illustrating a liquid level switch chamber connected to a pre-combustion vessel of an apparatus according to the present disclosure.
Figure 11:
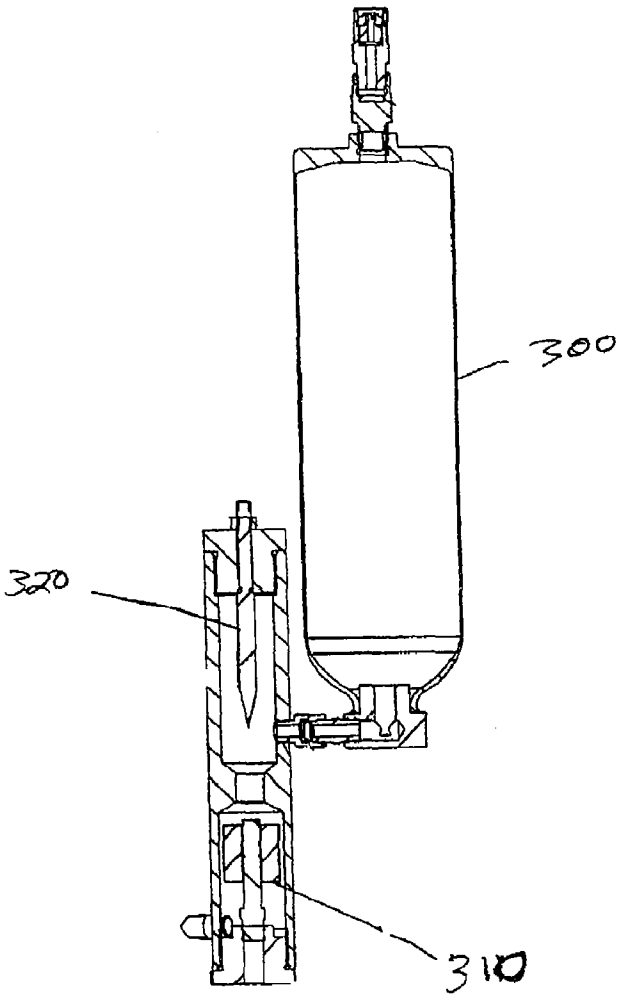
FIG. 11 illustrates a schematic of a float switch for an audible or visual alarm to alert the operator that the status of the service is near or at completion.

The exploded view of FIG. 4 illustrates the liquid level measuring apparatus with more specificity. As illustrated, the apparatus includes a liquid level switch 64, which can be a switch disposed on guide post 66 and retained on post 66 with clip 68. The switch 64 can include electrical contacts configured to close when the float reaches a down position relative to the vertical direction of post 66. The contacts of the float switch 64 may be, in turn, connected to a relay switch 70 that is used to operate or signal a 3-way solenoid valve 72, as shown in FIG. 1. In an embodiment, valve 72 can be pneumatically controlled or even manually controlled when the pre-combustion cleaner from vessel 12 is empty or near empty, the liquid level switch 64 activates relay 70, which, in turn, operates the 3-way solenoid valve 72. In an embodiment, a similar arrangement can be included with Vessel 14 to detect fluid levels from vessel 14. In this embodiment, the electric signal can be used to provide an indication that the cleaning process is nearing completion. Such a configuration is schematically illustrated in FIG. 11. This would allow the operator to shut off the apparatus prior to the vehicle running out of fuel completely and avoid setting a trouble code, as can occur on certain vehicles.

The 3-way solenoid valve 72 is used to alternately switch between two input lines 74 and 76 that respectively carry the pressurized pre-combustion and post-combustion liquid fuel/cleaners. These liquid fuel/cleaners can then be selectively delivered in sequence by valve 72 to output line 78 for delivery to the engine to be cleaned. Output line 78 may be connected to a check valve 80 that allows the fuel/cleaner to pass to a fuel filter 82, while ensuring that pressure is maintained in the fuel charging system, which includes the pre-combustion vessel 12 and post-combustion vessel 14, chambers 32 and 62, and the 3-way solenoid valve 72.

Apparatus 10 can also include a fuel/cleaner delivery system to deliver fuel/cleaner to an engine to be cleaned. The delivery system includes a fuel delivery hose or conduit 84 that is connected on an output of the fuel filter 82. A fuel line connect device 86 can be connected to the hose 84 and configured to connect and disconnect to a fuel line or fuel rail of the engine, such as with a quick connect device to afford ease and quickness of use.

Figure 5:
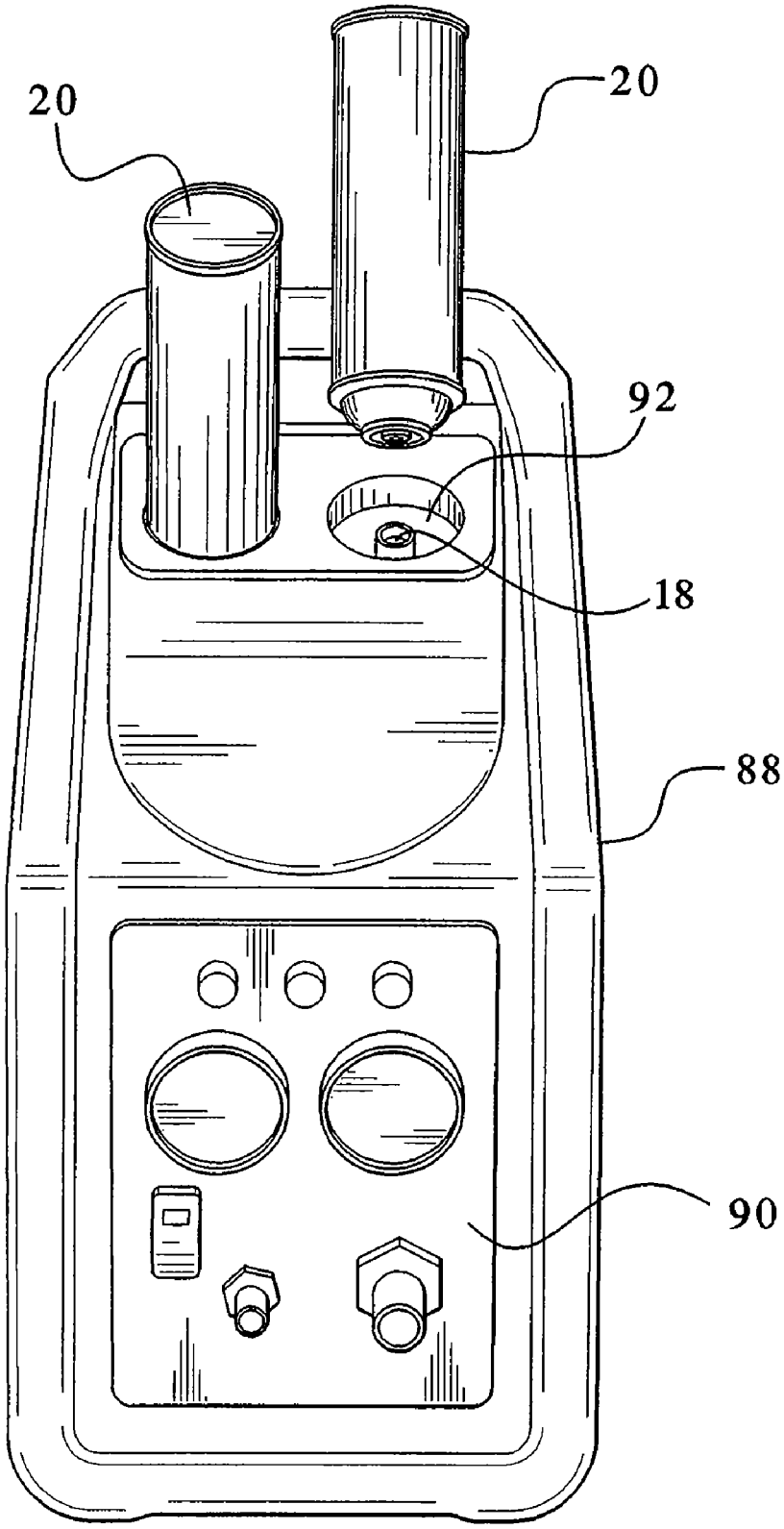
FIG. 5 illustrates a view of a housing assembly to house the apparatus of FIG. 1, including receptacles to receive pressurized aerosol containers and a control panel.

In order to contain apparatus 10 for ease of use and portability, the apparatus may be housed as a single unit. FIG. 5 illustrates a perspective view of an exemplary housing 88 for enclosing apparatus 10, illustrated in FIG. 1. As illustrated, housing 88 may also contain a control panel 90, which will be discussed later in connection with FIG. 6. The housing further includes one or more receptacles 92 that are configured to receive and hold cans 20 of cleaning fluids, including aerosol cans. Receptacles 92 can be designed with an opening allowing the piercing adaptors 18 to be exposed and connectable to cans 20 although any configuration that allows fluid communication between vessels 12 and 14 and pressurized cans 20 can be used. Thus, when the fuel charging system of apparatus is refilled with pre and post-combustion cleaners, aerosol cans 20 may be quickly and conveniently attached to apparatus 10 to deposit the cleaners contained therein.

Figure 6:
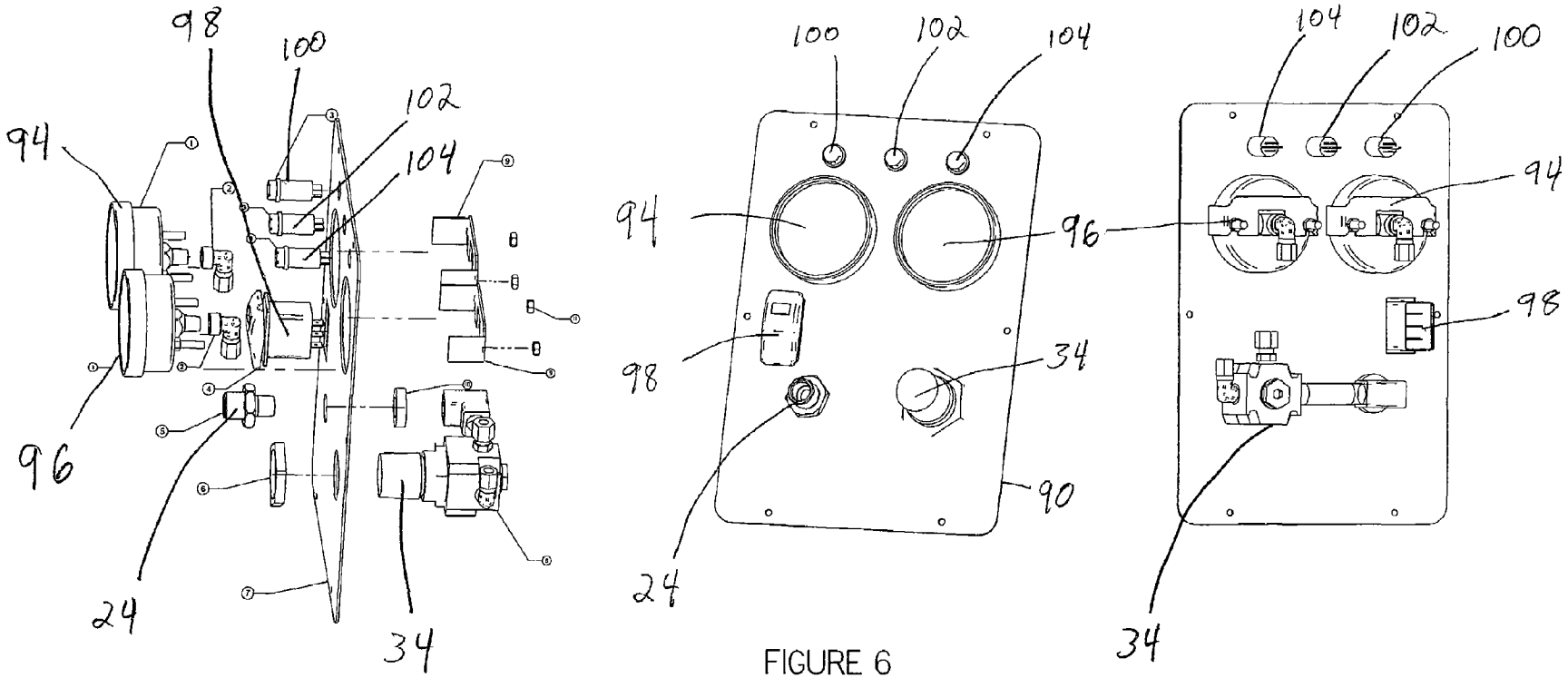
FIG. 6 illustrates a detailed perspective view of the control panel shown in FIG. 4.

FIG. 6 illustrates control panel 90 that enables control and monitoring of apparatus 10. Panel 90 includes an air pressure gauge 96 and a fuel pressure gauge 94 affording the respective monitoring of the pressure of the regulated air pressure and the fuel pressure of the fuel/cleaner being delivered to engine. The panel may also include an on/off switch 98 controlling, for example, power supply 44. In the presently disclosed apparatus, the voltage input to the power supply 44 is typical of an automobile, being 10-14 Volts DC. It should be appreciated, however, that various voltages could be used so long as the electronic components in the machine operate. Additionally, panel 90 may include indicators such as a reverse polarity indicator light 102, pre-combustion indicator light 100, and post-combustion indicator light 104. The reverse polarity indicator light 102 is dependent on the connection to a power source. The pre-combustion indicator light 100 is dependent on the liquid level switch and relay and whether the pre-combustion vessel was empty or not. The post-combustion indicator light 104 is dependent on the liquid level switch and relay and if the pre-combustion vessel is empty.

In an embodiment, panel 90 can be used to secure the pressure regulator 34 and allow the manual adjustment of air pressure. As illustrated, water separator 30 can be connected to the regulator 34 on the back side of the panel 90. The pressure regulator 34 may also be connected to the air pressure source with an air pressure conduit by means of the air inlet port 24, which can be a nipple fitting as shown or any other device for connecting the air pressure conduit to regulator 34, optionally via water separator 30 and threaded adapters.

In summary, apparatus 10 provides a device that is flexible in its configuration. The device can be configured to clean a combustion engine with a single pre-combustion cleaner. In an embodiment, apparatus 10 can be configured to clean a combustion engine with a post-combustion cleaner which can be given a negative charge prior to being introduced into the engine. Preferably, apparatus 10 is configured to clean an engine with a pre-combustion cleaner and a post-combustion cleaner in a single treatment service.

Prior to an engine cleaning treatment the fuel system is accessed to check the fuel pressure and the regulator function. During an engine treatment, the fuel line of a typical gas internal combustion engine can be disconnected, and a line from apparatus 10, which includes a quick-disconnect coupler 86, can be connected to the fuel system of the engine. The fuel pump of the engine can then be disabled. The regulator can be set to 0-10 PSI (0-69 Kpa) below the normal operating pressure of the engine to ensure than no chemical treatment is returned to the fuel tank and wasted. Thus, the treated fuel from one of vessels 12 or 14 will be substituted for the regular fuel into the engine. The engine is then started and runs on the fuel from one of vessels 12 or 14. In the example illustrated in FIG. 1, cleaner from vessel 12 is preferably provided first. When vessel 12 is emptied or nearly empty, float switch 64 can send a signal to relay switch 70, which, in turn, operates 3-way valve 72. Operation of valve 72 then switches the flow to connect line 76 to line 78, thereby delivering fuel from vessel 14 and chamber 32. Electrode 42 is energized from the power supply through the relay and imparts a negative charge in the fuel of vessel 14.

In order to load apparatus 10 with the cleaner, aerosol cans 20 are inserted into receptacles 92, connected to piercing adaptors 18, and the contents emptied into vessels 12 and 14. Air pressure source 26 can then be connected to pressure regulator 34 by means of air inlet 28. Apparatus 10 can then be activated and a charge of negative voltage is imparted to the treated fuel in chamber 32 by means of electrode 50. The pressure of air in vessels 12 and 14 can be manually or automatically regulated via pressure regulator 34 in order to provide a constant pressure to the fuel entering into the engine.

Figure 7:
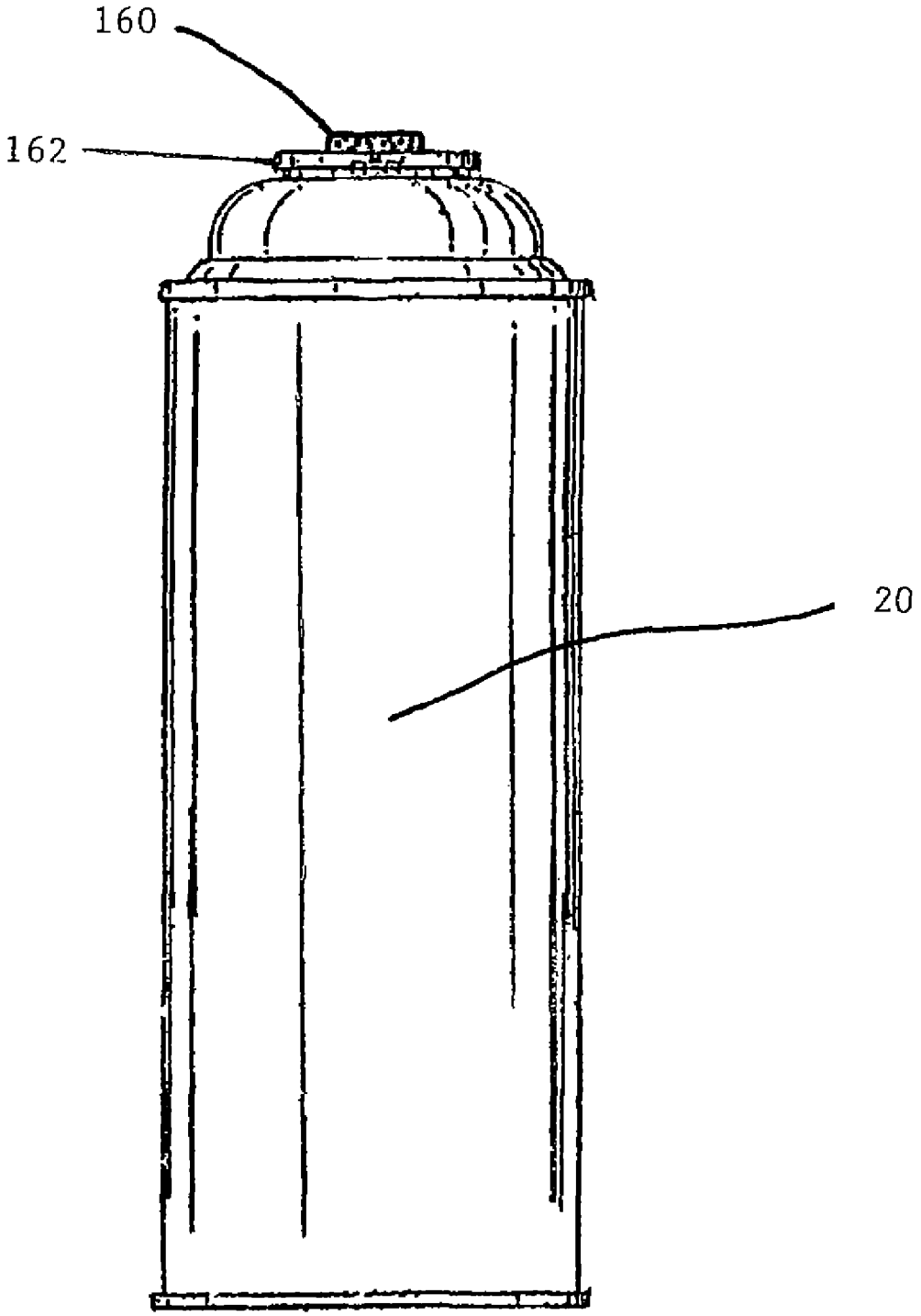
FIG. 7 illustrates an aerosol can that is pre-charged with the treatments for use with the apparatus of FIG. 1.
Figure 9:
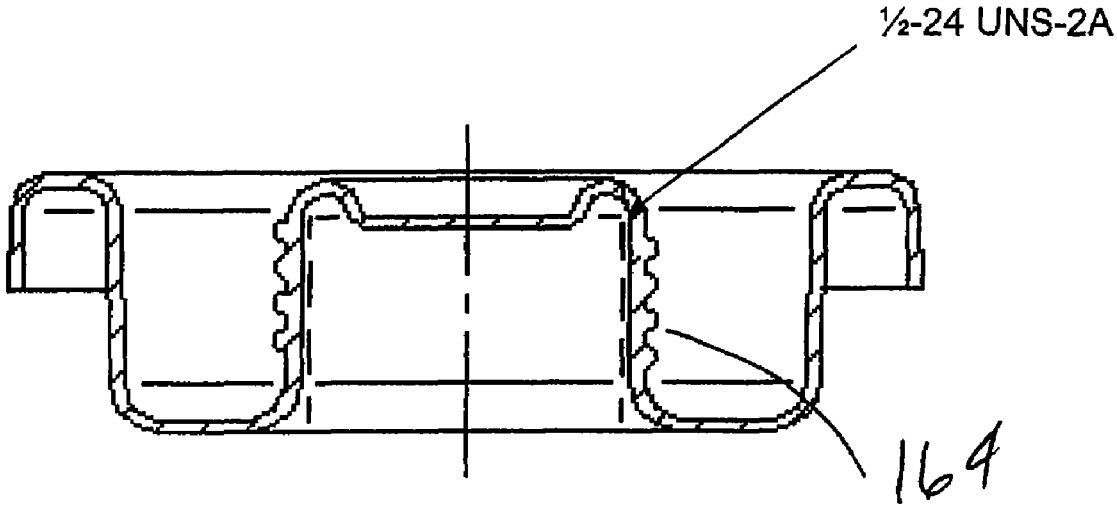
FIG. 9 illustrates a cross-sectional view of the cap portion of FIG. 8.
Figure 8:
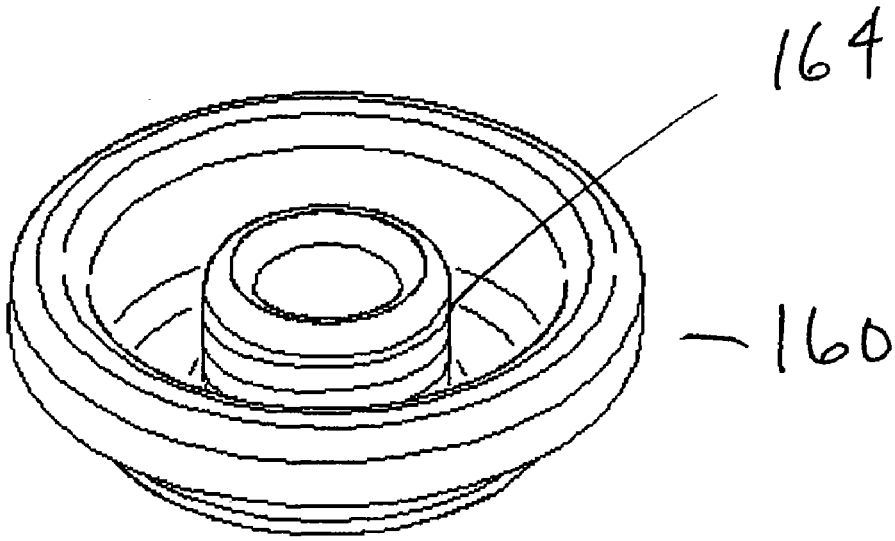
FIG. 8 illustrates a perspective view of a cap portion of the aerosol can of FIG. 7.

Exemplary aerosol cans 20, as illustrated in FIG. 7, may be pressurized with low pressure allowing the material to be charged quickly into apparatus 10. However, aerosol cans 20 may also be pressurized at higher pressures. Cans 20 can be equipped with a cap portion 160 disposed at an end 162 of can 20. As illustrated in FIGS. 8 and 9, cap portion 160 can include a threading portion 164 with a prescribed threading. This threading portion 164 can be configured to mate with threaded piercing adapter 18 of apparatus 10. Such an arrangement allows only cans having the prescribed threading of the threading portion 164 to be used with apparatus 10. An exemplary prescribed thread is an RH ½" 24 UNS as illustrated in FIG. 9.

The use of a metal can with a metal mating cap which connects into a metal piercing adapter 18 on the apparatus can be helpful from a safety aspect. The can may have a static electrical charge that needs to be eliminated prior to exposing the cans contents. The apparatus and cap design allow for metal to metal contact to safely eliminate any static charge prior to the can being pierced and opened, exposing the contents. The depth of the piercing point inside the adapter is chosen to safely allow this. Electrical bonding prevents any sparks as the can and apparatus would be at the same potential.

The requisite thread compatibility can be provided for several functional and safety aspects of apparatus 10, including prevention of unauthorized use of alternate chemicals, and quality assurance that cans 20 used with apparatus 10 were hermetically sealed to prevent any moisture ingression. The latter feature is effective for safety since high moisture or water in apparatus 10 may create a conductive path for the voltage or a corrosive atmosphere. Additionally, quality assurance is garnered by the mating can threading which assures that no air is introduced to the interior of the can that would oxidize the chemicals and reactions within the container prior to its use. This can be accomplished by charging the cans with an inert gas such as nitrogen or $CO_2$, which reduces the possibility of ignition. This quality assurance of charging also makes transportation of such cans less hazardous.

It is noted that because of the high voltages (near or exceeding −1000 volts) used in the above-described apparatus and safety considerations, the apparatus typically does not utilize any semi-conductive or conductive materials. If any additive in the compositions are accumulated in the apparatus, they may produce a conductive path which could be dangerous with any flammable material.

Figure 10:
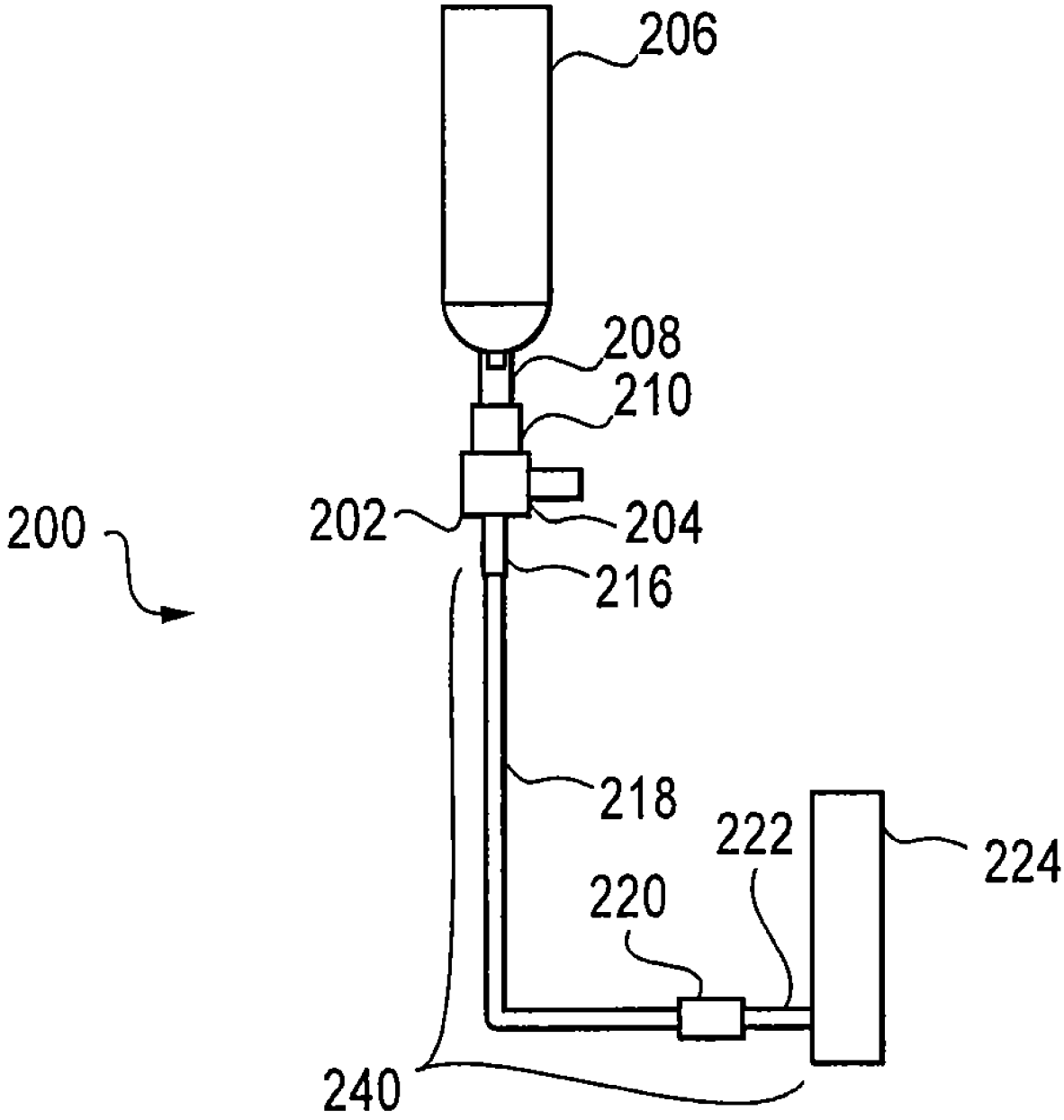
FIG. 10 illustrates another example of an apparatus according to the present disclosure operating without the use of voltage and air pressure.

FIG. 10 illustrates an embodiment of the invention in which apparatus 200 does not use negative voltage. Although the lack of a negative charging of the treatment cleaner may reduce the efficiency of the treatment by as much as 50%, apparatus 200 still uses the same pre-combustion cleaner and cleaning and can obtain the effects described above for the post-combustion cleaner. By eliminating the application of a high negative voltage and the corresponding apparatus to impart this voltage, a much smaller, less expensive apparatus can be produced. Apparatus 200, illustrated in FIG. 10, includes a pressure regulator 202 and a dispenser system 240 for the post-combustion cleaner. As illustrated, the apparatus 200 can include an aerosol container 206 connectable with an aerosol can piercing adaptor 208. A check valve 210 is connected to the piercing adaptor to receive pressurized fuel/cleaner from the aerosol can 206 and prevent flow back towards the can 206.

Connected to check valve 210 is adjustable pressure regulator 202 that affords setting and regulation of the pressure downstream of the regulator 202. This example is illustrated without the use of external pressurized air to afford more portability of the apparatus. Thus, the lack of an external air pressure source would necessitate that the aerosol cans 206 used with the apparatus 200 are pre-charged to a higher pressure than those used with the apparatus of FIG. 1 so that the regulator 202 can set the pressure to near the engine's specified fuel pressure without the addition of air.

A compression fitting 216 can be attached at an output of the regulator 202 in order to connect the regulator to a fuel delivery hose 218 that is part of the dispenser system 240. A valved quick coupler 220 is attached to the other end of hose 218 in order to afford quick connection of an adaptor 222 and engine fuel rail 224. The adaptor 222 may also be valved and the fuel rail 224 is configured to connect to the fuel system of the engine.

FIG. 11 illustrates an embodiment having a vessel 300 in connection with an electrode assembly 320 and a float switch 310. Switch 310 can be set to trigger an audible and/or visible alarm for the operator. It will give an indication that the service is completed or very near completion. This can be important in some newer cars where the vehicle electronics may set a "Check Engine" light that senses the vehicle is running out of gas when the service is completed. FIG. 1 illustrates an embodiment in which the float switch 310 is connected to the electrode assembly 32 for this alternate embodiment.

Figure 12:
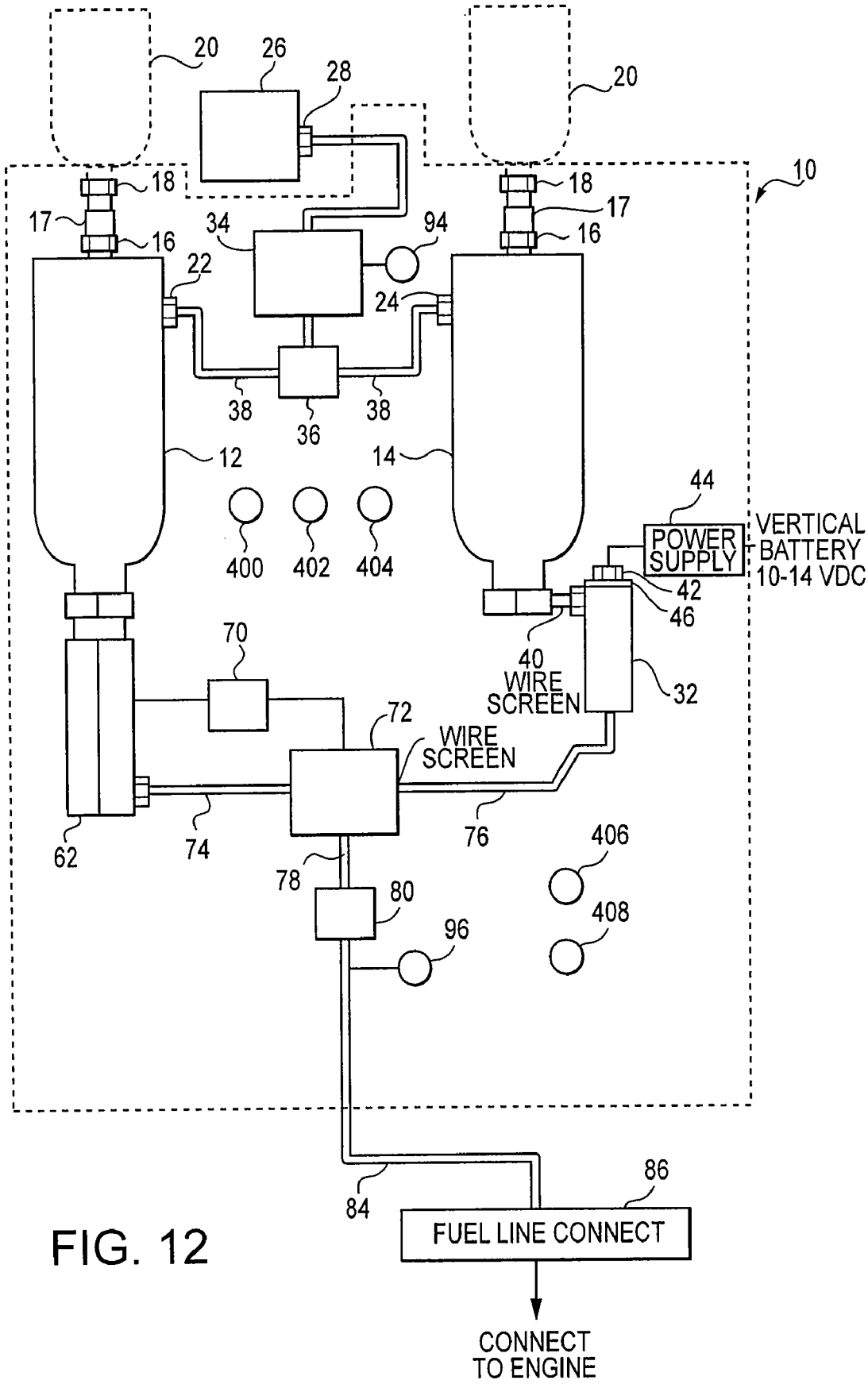
FIG. 12 illustrates a schematic of an alternate embodiment having a second float switch for an audible or visual alarm to alert the operator that the status of the service is near or at completion.

FIG. 12 illustrates an embodiment of treatment apparatus 10 that is similar to the embodiment of FIG. 1. However, the embodiment of FIG. 12 lacks water separator 30. Preferably, in this embodiment air pressure source 26 provides dry air so that moisture will not enter the system possibly interfering with the operation of electrical components of the system. Treatment apparatus 10 is enclosed in a dashed line which represents a housing. A variety of lights (400, 402, 404, and 406) are mounted on the housing and can be configured to provide an indication of the operation of the system. For example in the illustrated embodiment, light 400 can signal precombustion cleaning, light 404 can signal post-combustion cleaning, light 406 can indicate when treatment is complete and light 402 can indicate when the polarity of the connection to an external battery is reversed. Any signaling device can be used that provides an indication of the desired event. For example, buzzer 408 can be used in place of or in addition to light indicator 406 to indicate when treatment is complete.

FIG. 12 further illustrates that electrode vessel 32 can be attached to second vessel 14 via an outlet coupling 40 allowing the flow of fuel from vessel 14 to electrode vessel 32. Electrode assembly 32 can be configured with a float switch 310 in a similar manner as shown in FIG. 11.

The presently disclosed methods and compositions are helpful in mitigating harmful environmental effects typical of conventional engine cleaners and systems. Because chemicals for use in the apparatus are fuel derivatives tailpipe emissions are drastically reduced as compared to prior art fuel cleaners. This results in cleaner ambient air in the workplace and the emissions of the treated vehicle having undergone treatment are cleaner (i.e., have fewer hydrocarbon contaminants) than if prior known treatments were used. The disclosed fuel is cleaner than conventional fuels because the production process molecularly modifies and polarizes the streams of fuel petroleum distillates.

Additionally, the presently disclosed apparatus and methods utilize no chemical additives that increase polluting emissions over post-combustion treatments that only contain "light" fuel derivatives. Thus, the engine runs on a purified gasoline derivative so there are no risks to engine or emission components. Some newer automobile engine models incorporate plastic fuel injectors and intake manifolds. Many OEM's have prohibited the use of any fuel additives that may be corrosive or damage these plastic surfaces. The present post-combustion cleaner can be used in situations where prior art chemicals would be too corrosive, acidic or basic and would cause other ailments to electronic and sensitive sensors and components.

The present treatments have a mild gasoline smell and produce very little measurable tailpipe emissions during the service (very technician and operator friendly). Many governments and associations would be pleased with this novel approach. Additionally, CARB (California Air Research Board) and OSHA are always looking at reducing emissions in the workplace. This is a more environmentally friendly alternative to the highly toxic and corrosive fumes given off during conventional fuel injection cleaning treatments with detergents and solvents and other additives. Furthermore, vehicles can be emission tested immediately after the service without the need to run tanks of gas through the engine before an emission test as required prior art products and processes.

Oxygen sensors in modern fuel injection engines measure the air/fuel ratio and make finite adjustments to improve drivability, performance and fuel economy. As the sensor accumulates layers of carbon, it slows the reaction times, which increases the likelihood of increased fuel consumption and poorer response and drivability. Modern $O_2$ sensors are a replacement maintenance item and manufacturers typically recommend replacement at 50,000 to 100,000 miles (80,000 to 160,000 km) because of carbon build-up. The currently disclosed apparatus and methods allow rejuvenation of oxygen sensors and maintain the performance and durability of these sensors, and can be used to extend their useable life, indefinitely.

Moreover, catalytic converters used in engine exhaust systems are designed to allow the emissions from the engine (HC and CO) to contact the catalyst and be converted to non-harmful emissions of water and $CO_2$. When the catalyst becomes coated with carbon, however, the converter loses its efficiency allowing more contaminants to pass through to the tailpipe. Over time it can actually plug and cause engine damage and reduced power and performance. The currently disclosed apparatus and methods, with their added oxidation affects described above, have been used to clean and improve catalytic efficiency after treatment using the presently disclosed cleaning methods and apparatus.

Another new and common problem with carbon is the Exhaust Gas Recirculating (EGR) valve. This is a valve located on the engine. The EGR valve recirculates some of the burnt exhaust gases back through the engine to reduce pollution. Unfortunately, these valves have finely machined internal components which are susceptible to carbon buildup making them inoperable. Currently, these valves are only serviced by replacement. With the claimed apparatus, the exhaust gases will be able to enter the EGR valve and remove unwanted soft carbon deposits thereby extending the life and functionality of the EGR valve.

The cleaning fluids used in the present invention are prepared in a molecular reactor. One stream from the molecular reactor is composed predominantly of aliphatics (i.e., lighter, cleaner burning, dielectric elements). The other stream is predominantly the aromatics, which have higher potential energy and excellent solvent properties. The presently disclosed apparatus and methods preferably use a 2-step injector flush consisting of cleaning the injectors with the vehicle running on the aromatic-based stream, followed by a post-combustion clean up of the deposits created by the injector flush (all prior art products create post-combustion deposits) using the aliphatic fuel component. The pre-cleaning process has been demonstrated to open and clean a plugged fuel injector. In some extreme cases varnish and carbon can totally plug a fuel injector. This apparatus and process has demonstrated cleaning of such injectors and restoring flow back to 100% of the factory rating.

Another feature of these non-additive cleaners is their safe use for direct engine cleaning. For example, in a piston flush service for vehicles that have design problems that lead to a loss of oil control. Certain vehicle engine platforms are more prone to piston rings that get stuck and loaded with carbon. The result is that the engine consumes more oil and loses power, efficiency and fuel economy along the way. Many of these engines are then rebuilt or replaced. The presently disclosed apparatus and methods can be used for carbon removal by adding some treatment into the cylinder and allowing it to soak into the carbon residue. The result is usually that the engine is brought back to its originally intended free floating piston ring design, reversing the problem. The fuel consumption is reduced, and performance is regained and the oil loss problem is rectified. This can all be done without any foreign unwanted additives in the cleaning chemicals and without any added residual chemicals that may be harmful to internal engine components.

The post-combustion cleaning/emission service uses a unique mechanism for cleaning. The aliphatic-based stream is charged with about 1,000 volt negative charge before it enters the engine. The form of the gasoline and the charge creates conditions to release and remove carbon from post combustion engine and emissions control components. Without wishing to be bound by any particular theory, it is thought that at high temperatures carbon tends to have a positive electrical charge. The treatment chemical has a significant negative charge that could attract it to carbon. Because the treatment is such an efficient fuel and the engine is calibrated to run on standard gasoline there is extra oxygen available for use in the combustion chamber which may help to oxidize and burn off the carbon deposits.

In modern automobile gasoline engines, compression ratios have typically been increased to afford more horsepower from a smaller displacement engine. This has necessitated the addition of knock sensors on many engines. These sensors act as an alarm to sense pre-ignition as a result of a carbon deposits that have a sharp edge or hot-spot. The sensor triggers when the air-fuel mixture is heard detonating before the ignition system has sent the signal to the spark plug. The knock sensor sends a signal to the computer which immediately retards the ignition timing. The timing adjustment reduces fuel consumption, engine efficiency but keeps the engine from continued detonation and severe internal damage. By removing the carbon deposits in the combustion chamber, as the presently disclosed treatment does, it reduces the chances of pre-ignition.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. An apparatus for cleaning an internal combustion engine, fuel system and emission system comprising:

a first vessel including a first cleaning fluid, the first vessel being in fluid communication with a first cleaning fluid flow path, wherein the first cleaning fluid includes at least one of: (a) an engine fuel component enriched in aromatic compounds and (b) an engine fuel component enriched in aliphatic compounds;

a second vessel including a second different cleaning fluid, the second vessel being in fluid communication with a second different cleaning fluid flow path; and an electrode positioned in the second different cleaning fluid flow path, the electrode configured to apply an electrostatic charge to the second cleaning fluid, wherein both the first cleaning fluid flow path and the second different cleaning fluid flow path are in fluid communication with a same fluid delivery conduit configured to attach to a fuel line of the internal combustion engine, and wherein the apparatus is configured to deliver through the fluid delivery conduit both the first cleaning fluid and the electrostatically charged second cleaning fluid to the internal combustion engine in a fuel line and emission system cleaning process.

2. The apparatus for cleaning an internal combustion engine fuel system and emission system of claim 1, wherein the apparatus is portable.

3. The apparatus for cleaning an internal combustion engine, fuel system and emission system of claim 1, wherein the first cleaning fluid is primarily an engine fuel component enriched in aromatic compounds.

4. The apparatus for cleaning an internal combustion engine, fuel system and emission system of claim 1, wherein the second cleaning fluid includes at least one of: (a) an engine fuel component enriched in aromatic compounds and (b) an engine fuel component enriched in aliphatic compounds.

5. The apparatus for cleaning an internal combustion engine, fuel system and emission system of claim 1, wherein the second cleaning fluid is primarily an engine fuel component enriched in aliphatic compounds and wherein the electrode and a portion of the fuel are negatively charged.

6. The apparatus for cleaning an internal combustion engine, fuel system and emission system of claim 1, wherein the first cleaning fluid is enriched in aromatic compounds and the second cleaning fluid is enriched in aliphatic compounds.

7. The apparatus for cleaning an internal combustion engine, fuel system and emission system of claim 1, wherein the first cleaning fluid is enriched in aromatic compounds and is used in a pre-combustion cleaning process and the second cleaning fluid is enriched in aliphatic compounds and is used in a post-combustion cleaning process.

8. The apparatus for cleaning an internal combustion engine, fuel system and emission system of claim 1, wherein the apparatus further comprises a valve in fluid connection with the first and second vessels, the valve configured to deliver at least one of the first cleaning fluid and second cleaning fluid to an outlet of the valve, wherein the fluid delivery conduit is connected to the outlet of the valve.

9. The apparatus for cleaning an internal combustion engine, fuel system and emission system of claim 8, wherein the apparatus further comprises a three-way valve in fluid connection with the first and second vessels, the valve configured to deliver one of either the first cleaning fluid in the first vessel or second cleaning fluid in the second vessel to an outlet of the valve, and wherein the valve can be switched based on an input signal to deliver the other cleaning fluid, wherein the fluid delivery conduit is connected to the outlet of the valve.

10. The apparatus for cleaning an internal combustion engine, fuel system and emission system of claim 9, wherein the three-way valve is a solenoid operated valve and the input signal is an electrical signal.

11. The apparatus for cleaning an internal combustion engine, fuel system and emission system of claim 9, further comprising a float chamber attached to the first vessel to receive the first cleaning fluid from the first vessel; the float chamber comprising an electrical contact that delivers a signal when a low level of the first cleaning fluid is received by the float chamber.

12. The apparatus for cleaning an internal combustion engine, fuel system and emission system of claim 11, wherein the electrical contact is connected to the valve and delivers the signal to the valve.

13. The apparatus for cleaning an internal combustion engine, fuel system and emission system of claim 8, further comprising an electrode chamber in fluid communication with the second vessel for receiving the cleaning fluid, wherein the electrode is housed in the electrode chamber and is configured to charge the second cleaning fluid received by the electrode chamber.

14. The apparatus for cleaning an internal combustion engine, fuel system and emission system of claim 1, further comprising a housing enclosing the apparatus.

15. The apparatus for cleaning an internal combustion engine, fuel system and emission system of claim 1, further comprising a housing comprising a control panel that encloses the apparatus.

16. The apparatus for cleaning an internal combustion engine, fuel system and emission system of claim 1, further comprising:

an air inlet to receive pressurized air;

an air pressure regulator connected to the air inlet and configured to regulate an air pressure of the pressurized air;

an air distribution system configured to deliver the regulated pressurized air to at least one of the first vessel and the second vessel so as to pressurize the vessel.

17. The apparatus for cleaning an internal combustion engine, fuel system and emission system of claim 16, further comprising: a housing comprising a control panel that encloses the apparatus wherein the control panel includes a control input configured to control the air pressure regulated by the air pressure regulator.

18. The apparatus for cleaning an internal combustion engine, fuel system and emission system of claim 1, wherein at least one of the first vessel and the second vessel includes a fitting configured to receive and form a fluid connection with an aerosol can containing a cleaning fluid.

19. The apparatus for cleaning an internal combustion engine, fuel system and emission system of claim 1, wherein at least one of the first vessel and the second vessel includes a fitting configured to receive and form a fluid connection with an aerosol can containing a cleaning fluid and having a prescribed threading.

20. The apparatus for cleaning an internal combustion engine, fuel system and emission system of claim 1, wherein at least one of the first vessel and the second vessel includes a fitting configured to receive and form a fluid connection with an aerosol can containing a cleaning fluid and having a male ½"—UNS—24 right handed prescribed threading.

21. The apparatus for cleaning an internal combustion engine, fuel system and emission system of claim 1, further comprising a pressure supply for applying pressure to the at least one vessel that receives a cleaning fluid.

22. The apparatus for cleaning an internal combustion engine, fuel system and emission system of claim 1, further comprising a sensor for detecting the amount of cleaning fluid and sending a signal to an indicator system for indicating when the cleaning fluid level is low and the service is complete.

23. The apparatus for cleaning an internal combustion engine, fuel system and emission system of claim 1, further comprising an external power supply for applying a charge to the cleaning fluid and operating the system.

24. The apparatus for cleaning an internal combustion engine, fuel system and emission system of claim 1, further comprising an internal power supply for applying a charge to the cleaning fluid and operating the system.

25. An apparatus for cleaning an internal combustion engine, fuel system and emission system comprising:

a first vessel including a fitting configured to receive and form a fluid connection with a first aerosol can containing a first cleaning fluid, the first vessel being in fluid communication with a first cleaning fluid flow path, wherein the first cleaning fluid includes at least one of: (a) an engine fuel component enriched in aromatic compounds and (b) an engine fuel component enriched in aliphatic compounds;

a second vessel including a fitting configured to receive and form a fluid connection with a second aerosol can containing a second different cleaning fluid, the second vessel being in fluid communication with a second different cleaning fluid flow path, wherein the second cleaning fluid includes at least one of: (a) an engine fuel component enriched in aromatic compounds and (b) an engine fuel component enriched in aliphatic compounds; and an electrode positioned in the second different cleaning fluid flow path, the electrode configured to apply an electrostatic charge to the second cleaning fluid, wherein both the first cleaning fluid flow path and the second different cleaning fluid flow path are in fluid communication with a same fluid delivery conduit configured to attach to a fuel line of the internal combustion engine, and wherein the apparatus is configured to deliver through the fluid delivery conduit both the first cleaning fluid and the electrostatically charged second cleaning fluid to the internal combustion engine in a fuel line and emission system cleaning process.

26. The apparatus for cleaning an internal combustion engine fuel system and emission system of claim 25, wherein the first cleaning fluid is primarily an engine fuel component enriched in aromatic compounds.

27. The apparatus for cleaning an internal combustion engine, fuel system and emission system of claim 25, wherein the second cleaning fluid is primarily an engine fuel component enriched in aliphatic compounds.

28. The apparatus for cleaning an internal combustion engine, fuel system and emission system of claim 25, wherein the first cleaning fluid is enriched in aromatic compounds and the second cleaning fluid is enriched in aliphatic compounds.

* * * * *